US005542859A

United States Patent [19]

Ison et al.

[11] Patent Number: 5,542,859

[45] Date of Patent: Aug. 6, 1996

[54] QUICK MOUNT ELECTRICAL WALL SOCKET

[75] Inventors: Wendell Ison, Columbus; Douglas Wright, Clermont; Scott Ireland, Noblesville; Geoffrey Hicks, Carmel; Bradley J. Hyde, Greenfield, all of Ind.

[73] Assignee: Woods Industries, Inc., Carmel, Ind.

[21] Appl. No.: 340,846

[22] Filed: Nov. 16, 1994

[51] Int. Cl.[6] ..... H01R 13/74

[52] U.S. Cl. ..... 439/536; 248/27.1

[58] Field of Search ..... 439/536–539, 439/546–549, 544, 555, 557, 558; 248/27.1, 27.3, 231.9; 174/66, 67, 151

[56] References Cited

U.S. PATENT DOCUMENTS

| | | | |
|---|---|---|---|
| D. 225,740 | 1/1973 | Thompson . | |
| 1,987,035 | 1/1935 | Tideman . | |
| 2,448,359 | 8/1948 | Davidson . | |
| 2,687,862 | 8/1954 | Crowther . | |
| 2,891,103 | 6/1959 | Swengel . | |
| 2,892,011 | 6/1959 | Glueckstein . | |
| 2,992,754 | 7/1961 | Grimes . | |
| 3,005,178 | 10/1961 | Radack . | |
| 3,337,836 | 8/1967 | Churla, Jr. . | |
| 3,366,729 | 1/1968 | Pauza . | |
| 3,523,269 | 8/1970 | Witek, Jr. et al. . | |
| 3,543,219 | 11/1970 | Pautrie . | |
| 3,617,989 | 11/1971 | Heath . | |
| 3,631,738 | 1/1972 | Harper . | |
| 3,643,132 | 2/1972 | Odmark . | |
| 3,790,923 | 2/1974 | Mathe . | |
| 4,043,629 | 8/1977 | Brannen . | |
| 4,104,690 | 8/1978 | Custor et al. . | |
| 4,227,594 | 10/1980 | Kluger . | |
| 4,257,028 | 3/1981 | Narozny et al. . | |
| 4,340,795 | 7/1982 | Arthur . | |
| 4,406,936 | 9/1983 | Ohashi | 248/27.1 |
| 4,407,559 | 10/1983 | Meyer . | |
| 4,434,339 | 2/1984 | Ohashi | 248/27.3 |
| 4,451,106 | 5/1984 | Wiseheart et al. . | |
| 4,586,843 | 5/1986 | Heng et al. . | |
| 4,588,854 | 5/1986 | Bailey et al. . | |
| 4,681,288 | 7/1987 | Nakamura . | |
| 4,711,507 | 12/1987 | Noorily | 439/292 |
| 4,717,358 | 1/1988 | Chaundy | 439/557 |
| 4,722,136 | 2/1988 | Justiano et al. | 439/557 |
| 4,824,387 | 4/1989 | deJong et al. | 439/248 |
| 4,835,833 | 6/1989 | McDonald | 248/27.1 |
| 4,840,584 | 6/1989 | Cox | 439/538 |
| 4,909,748 | 3/1990 | Kozono et al. | 439/247 |
| 5,021,009 | 6/1991 | Cox | 439/538 |
| 5,066,247 | 11/1991 | Watson . | |
| 5,125,852 | 6/1992 | Archer | 439/555 |
| 5,131,867 | 7/1992 | Peloza et al. | 439/557 |
| 5,146,056 | 9/1992 | Kucynski | 200/296 |
| 5,171,164 | 12/1992 | O'Neil et al. | 439/552 |
| 5,178,554 | 1/1993 | Siemon et al. | 439/557 |
| 5,217,190 | 6/1993 | Reed et al. | 248/27.3 |

FOREIGN PATENT DOCUMENTS

| | | |
|---|---|---|
| 3430667 | 3/1986 | Germany . |
| WO93/024975 | 12/1993 | WIPO . |

*Primary Examiner*—Gary F. Paumen

*Attorney, Agent, or Firm*—McAndrews, Held & Malloy, Ltd.

[57] ABSTRACT

A wall mountable electrical socket for securement in an opening formed in a plasterboard wall. The socket includes a wall plate having a central opening with a rearwardly extending cylindrical member, and a plug housing insertable through the opening. Guide slots in the cylindrical member guide the housing to a position of locking engagement. During insertion, the housing cams tine members of the cylindrical member into piercing engagement with the wall.

27 Claims, 5 Drawing Sheets

QUICK MOUNT ELECTRICAL WALL SOCKET

BACKGROUND OF THE INVENTION

The present invention relates to an electrical connector capable of being mounted securely within a wall member, and more particularly relates to an electrical socket quickly mountable to a gypsum type wall made from plasterboard.

Heretofore, electrical wall outlets have been mounted into wall structures, including drywall, by initially cutting an opening into the wall, passing the socket into the wall and then securing the socket to the wall by screws or other fasteners. Such electrical sockets are labor intensive in their securement.

To overcome this disadvantage, electrical sockets have been developed which may be quickly mounted into position relative to a wall. Such quick mount wall sockets typically include two mating components. An outer component includes a face plate and socket structure which is pushed through a sized opening in the wall. An inner component passes into the socket and via a biasing structure applies force against the back surface of the wall member in order to bias the outer member into the wall pulling the outer face plate tightly against the front wall surface. See for example, U.S. Pat. No. 5,021,009, issued to Michael Cox on Jun. 4, 1991.

However, should repair or replacement of the electrical components carried by the socket be required, the removal of the socket may weaken or destroy the biasing structure.

SUMMARY OF THE INVENTION

It is therefore an object of the present invention to provide an improved wall mountable electrical socket.

It is yet another object of the present invention to provide an electrical wall socket in which the socket may be mounted quickly into a wall.

It is another object of the present invention to provide an electrical wall socket which facilitates servicing, inspection and replacement of the electrical components carried by the socket.

It is a further object of the present invention to provide a quick mount wall socket in which an inner component housing electrical connectors may be easily removed for permitting inspection, servicing or replacement thereof.

It is yet another object of the present invention to provide quick mount wall socket having a replaceable inner component which houses electrical components and which is lockable into position.

It is yet another of the present invention to provide an electrical wall socket in which the electrical component may be easily replaced.

These and other objects of the invention are achieved in a quick mount electrical wall socket comprised of a wall support mounting structure and a plug housing. The wall support mounting structure is formed of an outer wall plate and a plug support extending outwardly from the back side of the wall plate. The plug support is positioned through an aperture formed in the wall until the wall plate is pushed tight against the front surface of the wall. The plug support includes a plurality of frictional biting arms which are moveable for engagement with the wall. The plug housing carries an electrical connector and is shaped for mating engagement with the plug support as the plug housing passes through the wall aperture into engagement with the plug support. The plug housing drives the biting arms outwardly to bite into the wall so as to mount the wall support mounting structure to the wall.

DETAILED DESCRIPTION OF THE INVENTION

Figure 1:
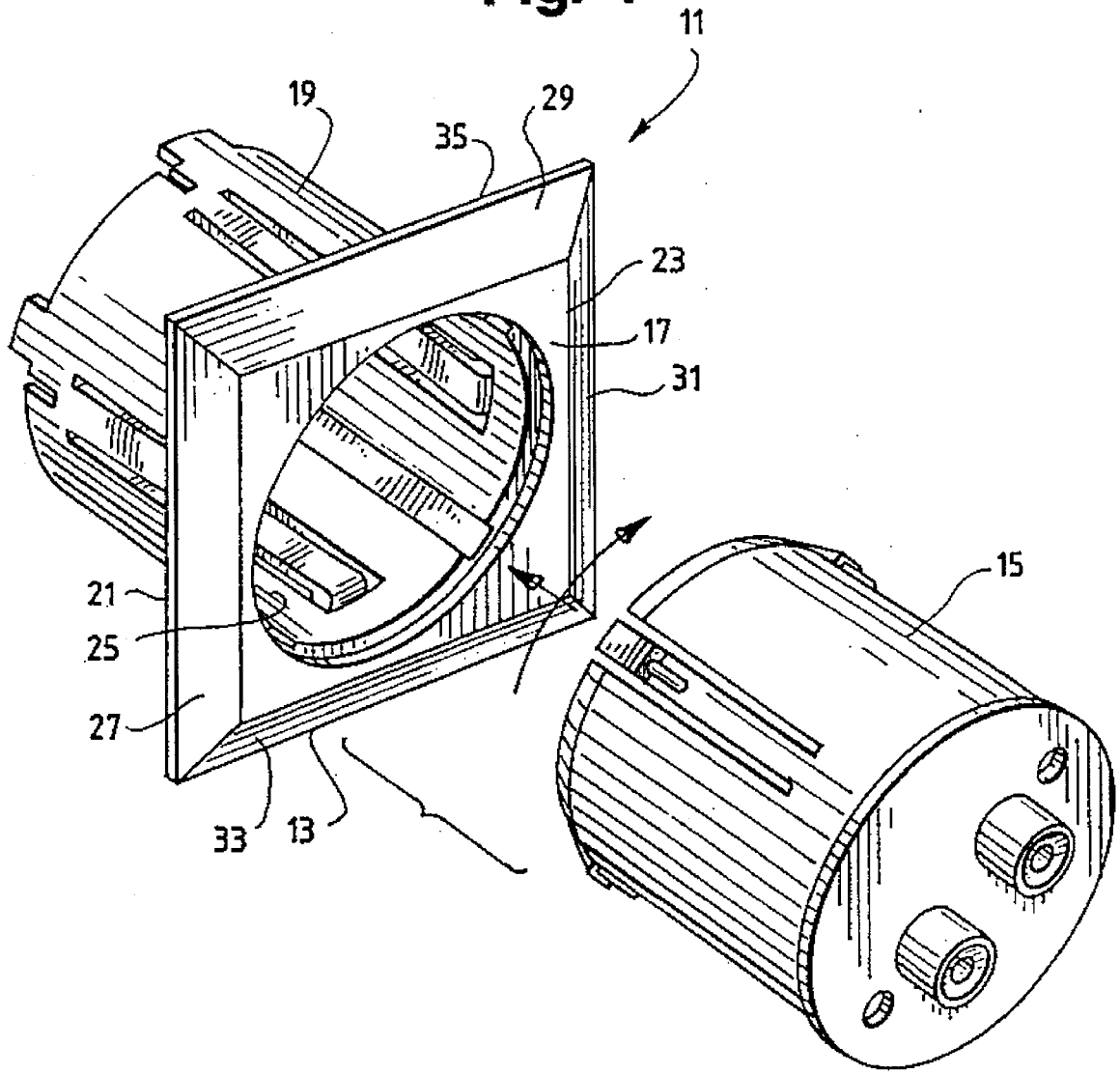
FIG. 1 is perspective view of a quick mount electrical wall socket according to the present invention.

Referring to FIG. 1, a quick mount electronic wall socket 11 is formed of a wall support 13 and a plug housing 15. Wall support 13 is molded as a single piece from plastic and is shaped to include a planar wall plate 17 and a cylindrically shaped guide support 19. Plug housing 15 is cylindrical in shape and of a size for insertion through a circular aperture 25 formed in plate 17.

Plate 17 is relatively thin, being of square shaped configuration, and having a back surface 21 and a front surface 23. Aperture 25 is centrally located in the plate and passes completely therethrough.

Front surface 23 is formed with outer beveled faces 27, 29, 31, and 33 which progressively narrow the plate thickness from its middle towards the outer edges 35 of the plate. Faces 27–33 are contiguous at their sides and shaped as trapezoids. The faces provide a smooth contour to the overall wall surface after socket 11 has been mounted to a wall.

Figure 2:
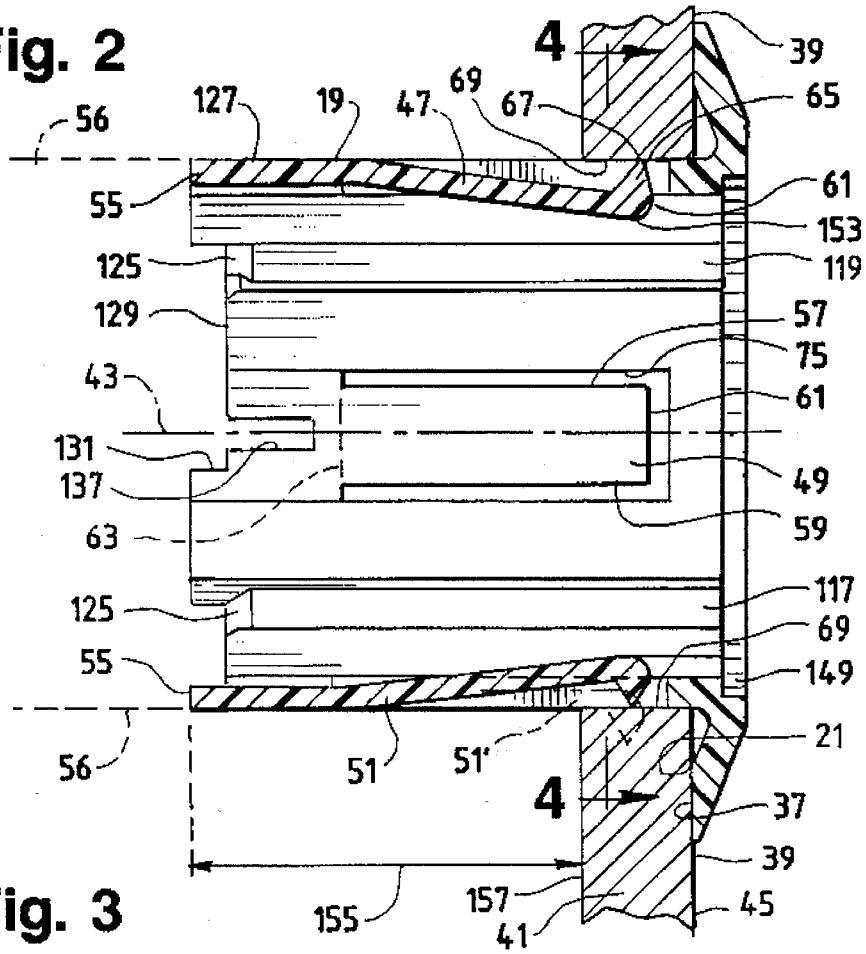
FIG. 2 is a cross sectional side view of the wall support of the socket of FIG. 1.

Referring to FIG. 2, back surface 21 of plate 17 includes a flat area 37 for making abutting contact with the flat front surface 39 of a wall 41. Wall 41 is a conventional plasterboard, often called drywall or wall board, formed of plaster, or other similar material. A circular opening 69 is formed in wall 41 and is of a size for receiving guide support 19.

Cylindrical guide support 19 is integrally molded to plate 17 extending outwardly from back surface 21 of the plate. The cylindrical axis 43 of support 19 is orthogonal to the plane 45 defined by the flat area 37 of the back surface of the plate 17.

Figure 3:
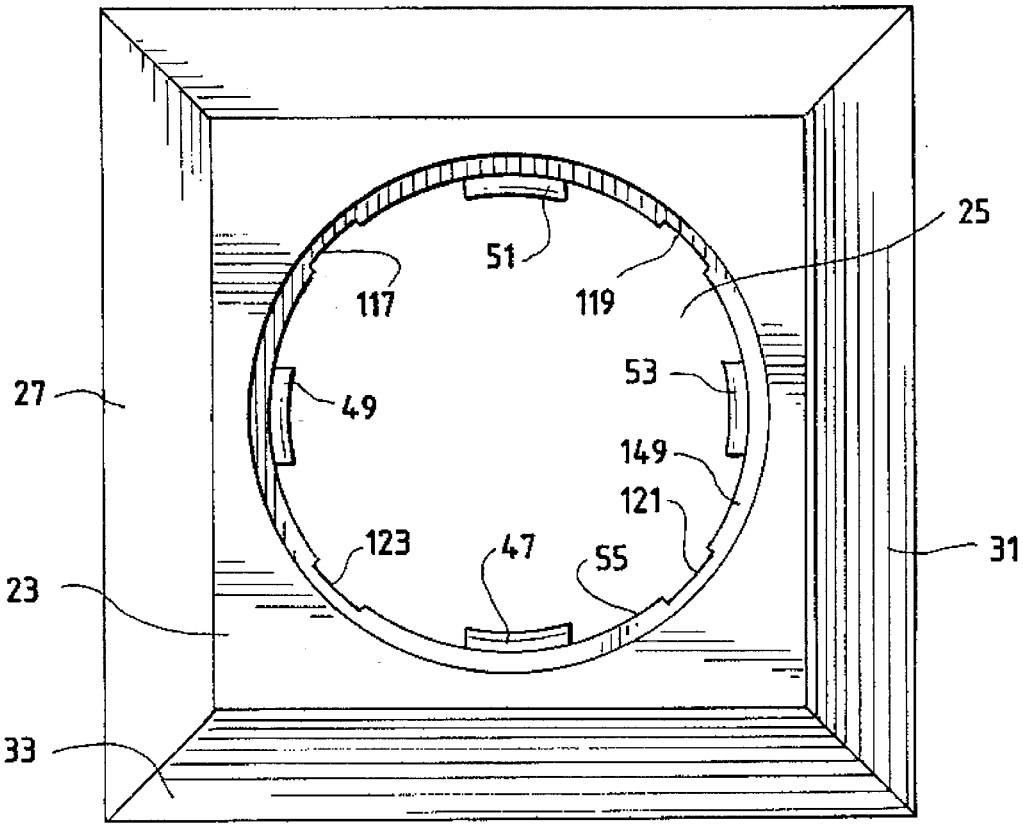
FIG. 3 is a front view of the wall support of FIG. 1.

Referring to FIGS. 2 and 3, cylindrical support 19 includes four lever arms 47, 49, 51, and 53. Each lever arm is formed as an arcuate, axially elongated segment of the cylindrical side wall 55 of cylindrical support 19. Each lever arm has two free sides 57, 59, a proximal free end 61 located closest to plate 15 and a distal end 63 formed integral to side wall 55. Each lever arm pivots or flexes about its distal end 63 permitting movement of the lever arm relative to the cylinder plane 56 defined by the outer diameter of side wall 55.

The thickness of the plastic material forming the side wall allows the lever arm to pivot or flex radially outwardly a small distance, as described hereinafter. As shown in FIG. 2, an aperture 75 surrounds the two sides and proximal end of the lever arm to provide clearance for pivoting of the arm within the aperture from the arm's distal end 63.

Figure 4:
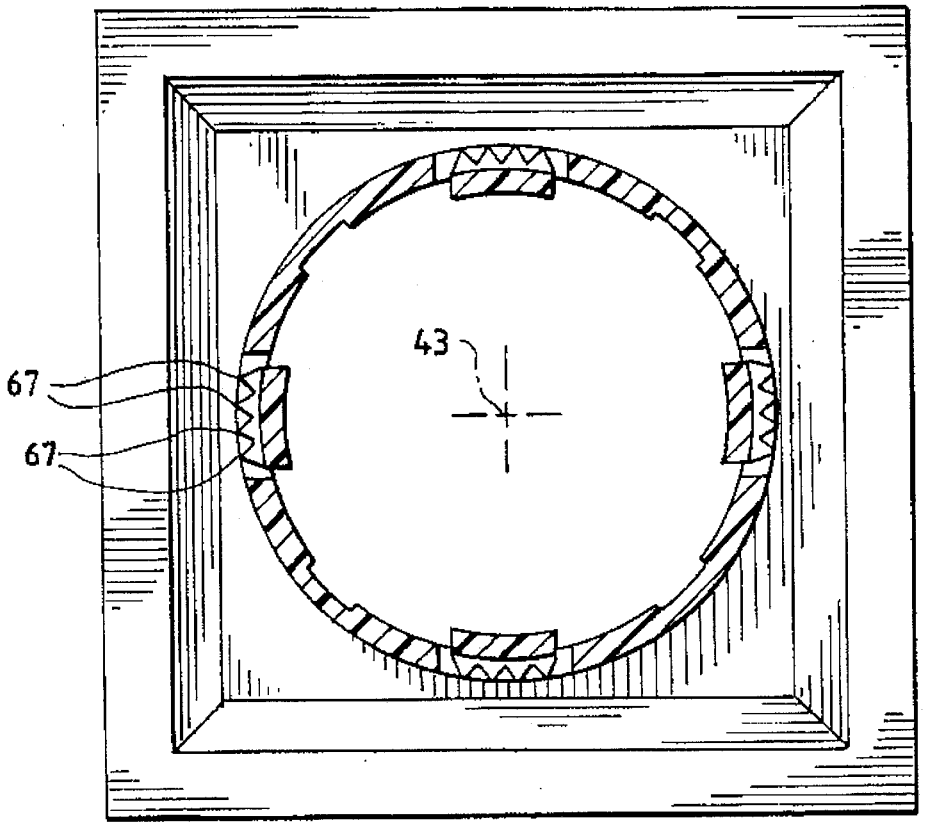
FIG. 4 is a cross sectional rear view of the wall support taken along line 4—4 of FIG. 2.
Figure 5:
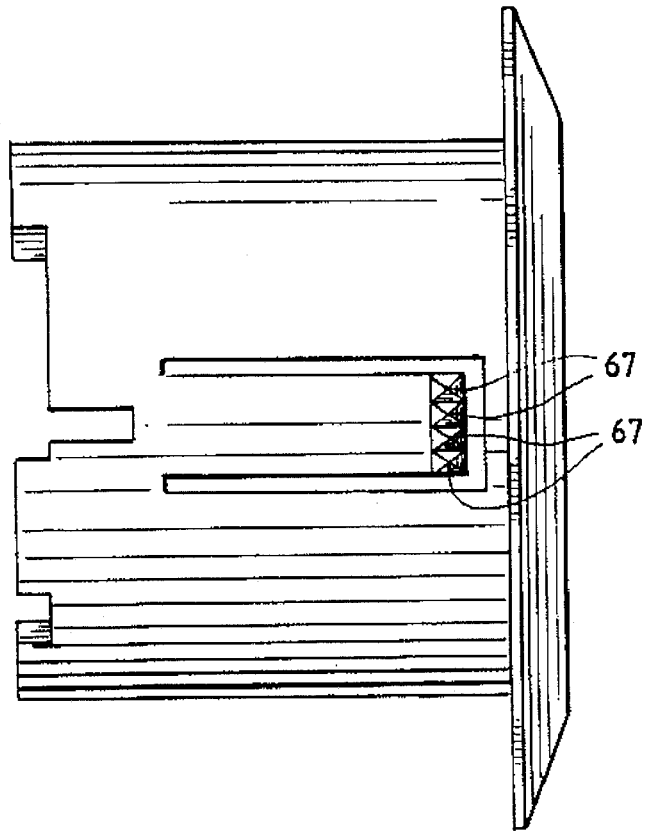
FIG. 5 is a side view of the wall support of FIG. 1.

Referring to FIGS. 2, 4, and 5, a sharp pointed tine or biting member 65 (FIG. 2) is formed at the proximal end 61 of each lever arm. Biting member 65 is constructed from four side-by-side teeth 67 (FIG. 4) which extend radially outwardly relative to cylindrical axis 43. Teeth 67 are disposed a short distance distally from the back surface of the plate and in alignment with wall 41 when the plate is set against the front surface of the wall. Teeth 67 pierce into the plasterboard material which composes wall 41 when the lever arm carrying the teeth is flexed radially outwardly. As shown in FIG. 5, each tooth 67 is pyramidal in shape.

Referring to FIG. 2, each lever arm 47, 49, 51, 53 has a normally relaxed position as shown by arm 47 in which the arm is angularly disposed with respect to the cylinder plane 56. The proximal end 61 of the lever arm is disposed radially inwardly from plane 56 to an extent for maintaining teeth 67 within the cylinder plane 56. This relaxed position of the lever arms permits guide support 19 to be slid into circular opening 69 cut in plasterboard wall 41.

As shown in FIG. 2, each lever arm 47, 49, 51, 53 has an extended position (shown in phantom by lever arm 51') in which the arm aligns with the rest of the cylindrical side wall 55. Each arm is pivoted or flexed radially outwardly to its extended position wherein teeth 67 are driven into plasterboard wall 41. Once forced into the extended position, the lever arms and teeth prevent the cylindrical guide support 19 from being pulled back outwardly from plasterboard wall 41.

Figure 6:
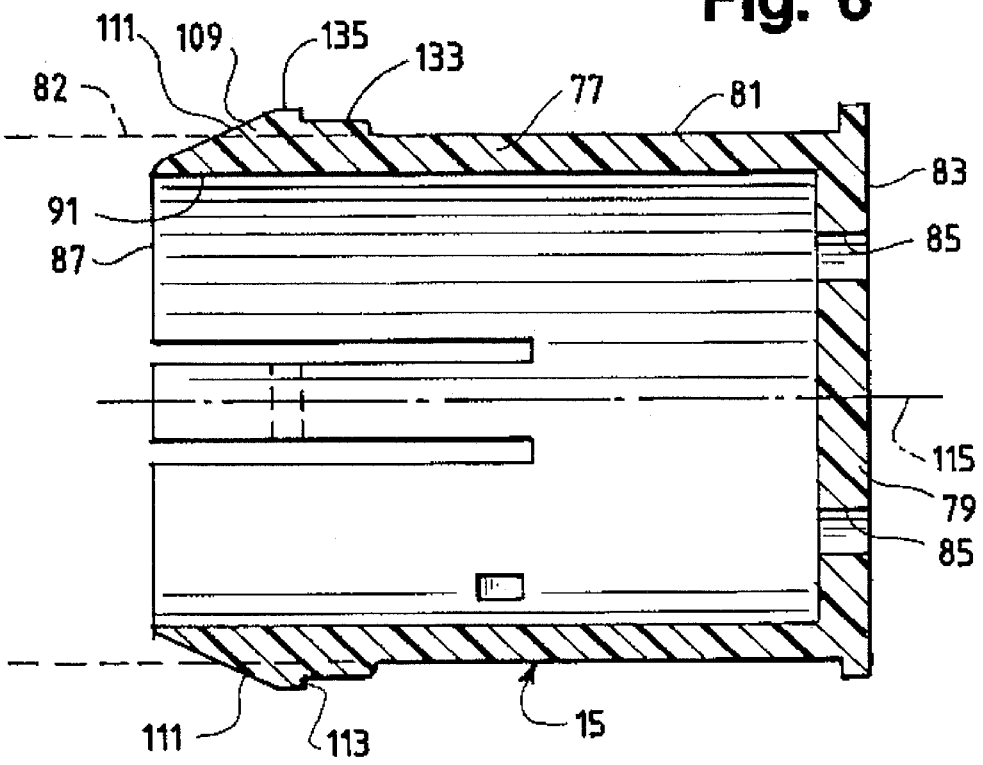
FIG. 6 is a cross sectional side view of the plug housing of FIG. 1.

Referring to FIG. 6, plug housing 15 is molded from a single piece of plastic and is shaped to include a cylindrical side wall 77 and a circular top member 79. Top member 79 is slightly larger in diameter than the outer cylindrical surface 81 of side wall 77. Top member 79 has a flat top surface 83 through which one or more apertures 85 are formed.

Apertures 85 may, for example, provide plug access to electrical connectors (not shown) mounted within housing 15. Alternatively, apertures 85 may permit protrusion outwardly of electrical connectors extending from the top surface 83 to permit easy access to such connectors. Connectors housed within or extended from housing 15 may include speaker terminals, phone jacks, coax cable connectors, etc.

Figure 7:
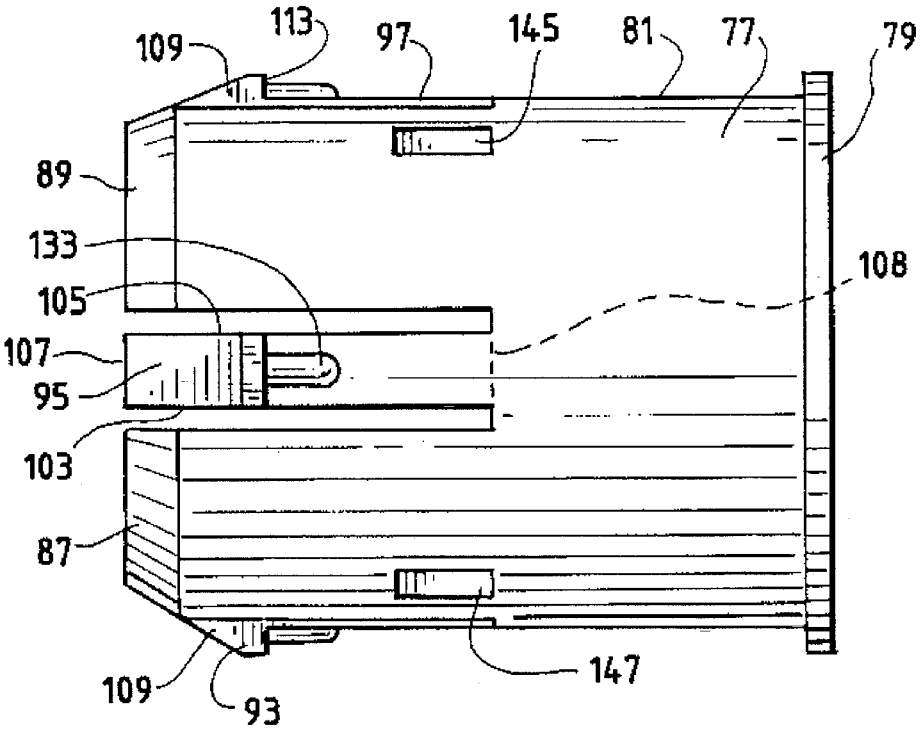
FIG. 7 is a side view of the plug housing of FIG. 1.

Referring to FIGS. 6 and 7, the distal end 87 of cylindrical side wall 77 is shaped with a beveled surface 89 traversing completely around the perimeter of the side wall. Surface 89 extends distally at an angle from the outer surface 81 to almost the inner cylindrical surface 91 of the side wall. Beveled surface 89 serves as a guide surface during insertion of the plug housing 15 into aperture 25 of wall plate 17.

Figure 8:
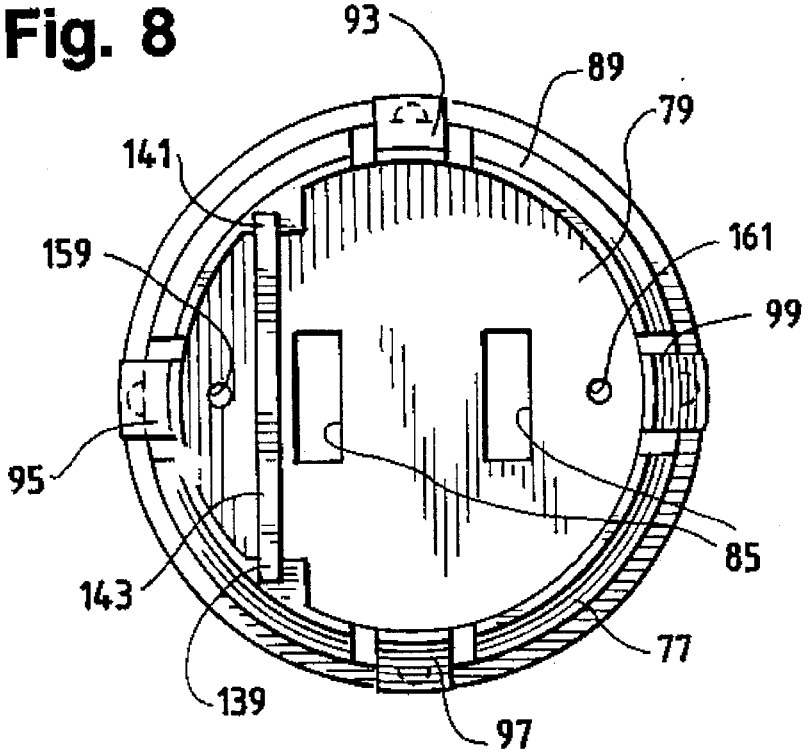
FIG. 8 is a bottom view of the plug housing of FIG. 1.

As shown in FIGS. 7 and 8, side wall 77 includes four fingers 93, 95, 97, and 99, each formed as an arcuate, axially elongated segment of the cylindrical side wall 77 of housing 15. Each finger has two free sides 103, 105, a distal free end 107 and a proximal end 108 formed integral to side wall 77. Each finger pivots or flexes about its proximal end 108 permitting movement of the finger relative to the cylinder plane 82 (FIG. 6) defined by outer cylindrical surface 81. The thickness of the plastic material forming the side wall 77 allows the fingers to pivot or flex radially inwardly and outwardly.

As shown in FIGS. 6 and 7, each finger includes a protruding nose 109 formed at the distal end of the finger. Nose 109 extends laterally from outer cylindrical surface 81 and has a camming surface 111 formed an extension of beveled surface 89, projecting outwardly from surface 81. Camming surface 111 is disposed at approximately the same or slightly greater angle as beveled surface 89.

Nose 109 further includes a ledge 113 (FIG. 6) which is disposed in a plane orthogonal to cylindrical axis 115 of cylindrical surface 81. Ledge 113 extends inwardly from the outer surface of nose 109.

Referring again to FIG. 3, cylindrical side wall 55 of the guide support includes four axial slots 117, 119, 121, 123 formed in the interior surface of side wall 55. As shown in FIG. 2, each of slots 117, 119, 121, 123 extend the length of wall 55 and terminate in a beveled surface 125 angled radially outwardly toward outer surface 127 of side wall 55. The width of each slot 117–123 is slightly greater than the width of nose 109 of each finger 93–99 of the plug housing. Each nose 109 is received within slots 117–123 and follows the slots as the plug housing is pressed into the cylindrical guide support. Thus, slots 117–123 guide the noses 109 during insertion of the plug housing.

Initially, the plug housing 15 is rotated until each nose is aligned with a slot before pressure is applied to the plug housing to move the housing into position. As the housing is pressed into the support, the nose of each finger locks into a slot and prevents relative rotation between the support and plug housing. Camming surface 111 contacts the surface defining the slot to flex its associated finger radially inwardly as the housing is pressed into aperture 25. This establishes a spring bias on the finger tending to spring the finger radially outwardly.

When the finger moves axially to its fullest extent within the slot, camming surface 111 reaches beveled surface 125 permitting the finger to move radially outwardly due to its spring bias. Ledge 113 engages the distal edge 129 (FIG. 2) of the side wall 55 locking the plug housing to the cylindrical support. After nose ledge 113 springs outwardly and abuts edge 129, plug housing 15 may be rotated, sliding nose 109 over against stop edge 131 formed in the distal end of the plug housing. When nose 109 comes to rest against stop edge 131, the nose is out of axial alignment with its respective slot, making it more difficult to pull the plug housing from the cylindrical guide support.

In order to facilitate the rotational movement of the plug housing once nose 109 moves outward at the distal end of the slot, a cam surface 133 (FIG. 7) engages the surface defining the wall at the end of the slot. Cam surface 133 has a rounded surface, as seen in FIG. 7.

Referring to FIG. 6, cam surface 133 is spaced radially inward of fullest radial extent 135 of the cam surface 111. Thus, cam surface 133 does not engage the slot until the nose reaches the distal end of the slot. At the distal end of the slot, the nose moves outward, engaging the cam surface 131 and the surface defining the slot. Cam surface 133 serves to cam the finger inwardly during rotational movement of the finger, moving the finger out of the slot. Upon reaching stop surface 131, the cam surface 133 aligns with a slot 137 formed on side wall 55.

Referring to FIG. 8, the interior surface of plug support 15 is configured to form a pair of axially extending grooves or slots 139, 141. Slots 139, 141 are molded in the interior of the housing on opposed sides of the housing for receiving a printed circuit board 143. Printed circuit board 143 carries separate connectors (not shown) which are releasably connected to wiring disposed behind the wall 41 and to the connector jacks, etc (not shown) disposed, for example through apertures 85 of the top member 79.

Referring to FIG. 7, a pair of apertures 145, 147 are formed through the cylindrical side wall 77 for receiving protruding pins (not shown) formed on printed circuit board 143 to align and secure the board within the pair of slots 139, 141.

Referring to FIGS. 2 and 3, an annular channel 149 circumscribes the inside surface 151 of the cylindrical guide support. Channel 149 receives the circular top member 79 to provide top surface 83 of the plug housing flush with front surface 23 of the plate.

Referring to FIG. 2, plug housing 15 is pressed into aperture 25 in plate 17, the outer cylindrical surface 81 of the plug housing engages lever arms 47–53 driving them to their extended positions. The distal end 61 of each lever arm may include a cam surface 153 to facilitate engagement with the beveled surface 89 of the plug housing.

The guide support 19 is inserted through opening 69 formed in wall 41. Support 19 is inserted to a preset distance 155 at which the flat area of back surface 51 of the plate seats against the front surface of wall 41. When guide support 19 is inserted to the preset distance 155, tine 61 is aligned with the plane of the wall, (the "plane of the wall" being defined as the area between the front surface 39 and back surface 157 of the wall). Plug housing 15 is inserted a predetermined distance into opening 25 of the plate relative to the flat surface 37 thereof at which top member 79 seats into annular channel 49 and at which ledge 113 of the nose 109 locks against edge 129 of the side wall 55.

As shown in FIG. 8, top member 79 is formed with a pair of cylindrical openings 159, 161 which are spaced apart. Openings 159, 161 are sized for receiving a pair of prongs (not shown) of a tool (not shown) for rotating plug housing 15 relative to wall support 13. The prongs enter opening 159, 161 from the top surface 83 of the top member in order to provide a rotational grasp of the plug housing.

Figure 9:
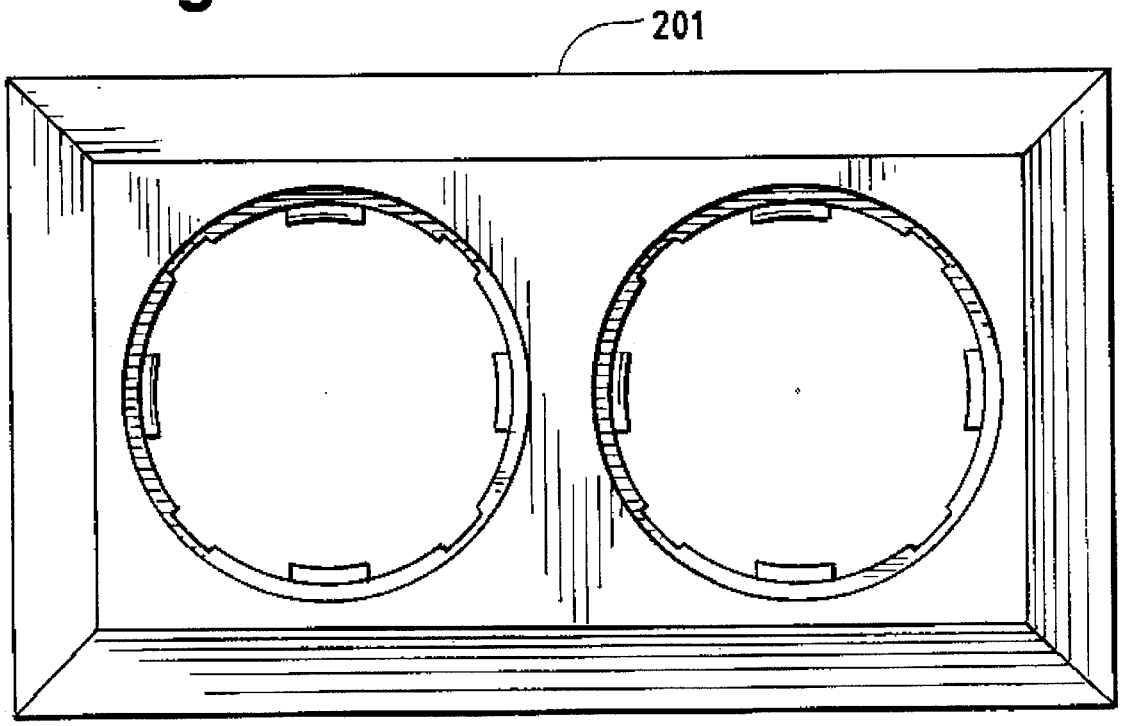
FIG. 9 is a front view of an alternate wall support having a pair of plug housing receiving apertures.

Referring to FIG. 9, wall socket 11 may be formed to include a pair of openings 25 and a pair of cylindrical guide supports 19. The wall support 201 may be secured to a wall by means other than biting members 65, for example, by screws, glue, adhesive, etc. In addition, a blank plug housing may be used to cover an opening 25 not needed. Such a blank plug housing will not include apertures 85 but will have a plain top member 79 without openings.

While only a single, preferred embodiment of the invention has been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A wall mountable electrical socket for securement in an opening formed in a plasterboard wall, the wall having a front surface and a rear surface, comprising:

a one-piece wall supporting unit for securement into a fixed position relative to a plasterboard wall, said supporting unit comprising:

(i) a plug support insertable through an opening formed in the wall to a preset distance, said plug support having a moveable piercing member carrying at least one tine, said tine being aligned with the plane of the wall when said plug support is inserted to said preset distance, said piercing member being moveable outwardly to force said tine into piercing engagement with the wall; and (ii) a wall plate integrally molded to said plug support, said wall plate defining an aperture for alignment with the opening of said wall when said plug support is inserted through the opening to said preset distance, said wall plate having a rear surface for contact with the front surface of the wall when said plug support is inserted into the opening to said preset distance; and a one-piece connector module for retaining an electrical connector, said module insertable into said aperture and the opening to a predetermined distance distal of said rear surface of said plate, said module mating with said plug support during insertion movement into the opening and thus forcing said tine into piercing engagement with an inner periphery of the wall opening.

2. A wall mountable electrical socket according to claim 1 wherein said piercing member has a cam surface; and wherein said module engages said cam surface for forcing said piercing member into piercing engagement with the wall.

3. A wall mountable electrical socket according to claim 1 wherein said plug support includes a plurality of moveable piercing members equally spaced relative to said open area of said wall plate.

4. A wall mountable electrical socket according to claim 1 wherein said plug support includes a cylindrically shaped member and wherein said moveable piercing member is an arcuate section of said cylindrical shaped member.

5. A wall mountable electrical socket according to claim 4 wherein said moveable piercing member is canted inwardly with respect to the cylindrical axis of said cylindrically shaped member.

6. A wall mountable electrical socket according to claim 1 wherein said piercing member is molded integral with said plug support at a point distal to said wall plate, said piercing member having a free end disposed between said last named point and said wall plate.

7. A wall mountable electrical socket according to claim 6 wherein said piercing member includes at least one tine located at said free end.

8. A wall mountable electrical socket according to claim 6 wherein said piercing member is angled inwardly from said point of integral attachment toward said free end relative to said opening.

9. A wall mountable electrical socket according to claim 6 wherein said free end includes a cam surface for engaging said connector module when said module is moved into said opening.

10. A wall mountable electrical socket according to claim 9 wherein said connector module includes a surface formed at its distal end, said surface engaging said cam surface of said free end when said connector module is inserted into said opening.

11. A wall mountable electrical socket according to claim 1 wherein the opening defines a longitudinal axis and wherein said wall plate is secured to said plug support for disposing said plate against the front surface of the wall orthogonal to said longitudinal axis when said plug support is disposed within the opening.

12. A wall mountable electrical socket according to claim 1 wherein said connector module includes a top end; and wherein said aperture includes an annular groove of a size for receiving said top end of said connector module, said top end seating in said annular groove and being flush with the outer surface of said wall plate.

13. A wall mountable electrical socket according to claim 12 wherein said top member of said connector module includes a pair of apertures of a size for receiving a tool to facilitate rotation of said connector module within said wall supporting unit.

14. A wall mountable electrical socket according to claim 1 wherein said one piece wall supporting unit is formed of plastic.

15. A wall mountable electrical socket for securement in an opening formed in a plasterboard wall, the wall having a front surface and a rear surface, comprising:

a wall supporting unit for securement into a fixed position relative to a plasterboard wall, said supporting unit comprising:

(i) a plug support insertable through an opening formed in the wall to a preset distance, said plug support having a moveable piercing member carrying at least one tine, said moveable member being disposed for movement of said tine into the plane of the wall to pierce the wall when said plug support is inserted to said preset distance; and (ii) a wall plate secured to said plug support, said wall plate having a rear surface for contact with the front surface of the wall when said plug support is inserted into the opening to said preset distance; and a module for retaining an electrical connector, said module insertable into the opening to a predetermined distance distal of said rear surface of said plate, said module contacting said plug support and forcing said tine into piercing engagement with an inner periphery of the wall opening.

16. A wall mountable electrical socket according to claim 15 wherein said plug support further includes a lock member; and wherein said module is engagable with said lock member for locking said module from outward retraction relative to said plug support.

17. A wall mountable electrical socket according to claim 15 wherein said plug support includes a channel; and wherein said module includes a channel follower which follows said channel as said module is moved into said opening.

18. A wall mountable electrical socket according to claim 16 wherein said lock member includes a surface formed at the distal end of said plug support.

19. A wall mountable electrical socket according to claim 17 wherein said channel follower is cammed inwardly by said plug support when said module is moved into said opening.

20. A wall mountable electrical socket according to claim 19 wherein said channel follower is biased outwardly when said module reaches said predetermined distance, said channel follower engaging said lock member at said predetermined distance.

21. A wall mountable electrical socket according to claim 15 wherein said module is rotatable upon reaching its extended position for providing locking engagement between said wall supporting unit and said module.

22. A wall mountable electrical socket according to claim 15 wherein said module includes a printed circuit board.

23. A wall mountable electrical socket according to claim 22 wherein said module includes a pair of opposed channels aligned for receiving a respective edge of said printed circuit board.

24. A wall mountable electrical socket according to claim 23 wherein said printed circuit board includes a protuberance; and wherein said module includes at least one configuration formed in the wall thereof for receiving said protuberance for locking said printed circuit board within said opposed channels.

25. A wall mountable electrical socket according to claim 17 wherein said channel follower includes a nose section, said nose section having a camming surface projecting outwardly at an angle, said nose section flexing said channel follower inwardly of the axis of said connector module.

26. A wall mountable electrical socket according to claim 25 wherein said channel follower includes a rotational camming surface of a size and location for non-contact engagement with said channel during inwardly flexing of said channel follower, and for engaging said plug support when said module reaches said predetermined distance, for facilitating camming during rotational movement of said module relative to said plug support.

27. A wall mountable electrical socket according to claim 17 wherein said module includes a plurality of said channel followers equally spaced about said connector module.

* * * * *